US005993268A

United States Patent [19]

Yamaguchi

[11] Patent Number: 5,993,268

[45] **Date of Patent: *Nov. 30, 1999**

[54] ELECTRICAL CONNECTOR WITH TERMINAL RETAINING MEANS

[75] Inventor: Noboru Yamaguchi, Shizuoka, Japan

[73] Assignee: Yazaki Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/882,676

[22] Filed: Jun. 25, 1997

[30] Foreign Application Priority Data

Jun. 25, 1996 [JP] Japan ..... 8-164676

[51] Int. Cl.[6] ..... H01R 13/514

[52] U.S. Cl. ..... 439/752.5; 439/746

[58] Field of Search ..... 439/752.5, 746, 439/748, 848, 849, 850

[56] References Cited

U.S. PATENT DOCUMENTS

| | | | |
|---|---|---|---|
| Re. 30,277 | 5/1980 | Simmons | 439/849 |
| 3,076,171 | 1/1963 | Hopkins | 439/849 |
| 3,386,074 | 5/1968 | Woofter | 439/748 |
| 4,557,543 | 12/1985 | McCleerey et al. | 439/748 |
| 5,458,426 | 10/1995 | Ito | 439/595 |
| 5,626,499 | 5/1997 | Yagi et al. | 439/752.5 |
| 5,664,969 | 9/1997 | Peterson et al. | 439/746 |

FOREIGN PATENT DOCUMENTS

| | | |
|---|---|---|
| OS 22 61 536 | 12/1972 | Germany . |
| 52-120394 | 3/1951 | Japan . |

*Primary Examiner*—Khelm Nguyen
*Assistant Examiner*—T C Patel
*Attorney, Agent, or Firm*—Sughrue, Mion, Zinn Macpeak & Seas, PLLC

[57] ABSTRACT

A connector in which an electrical contact portion of a female terminal has a tubular portion corresponding in shape to a terminal receiving chamber in a connector housing. A slit is formed in the tubular portion, and extends in a direction of insertion of the terminal. An engagement projection which is slidably fitted in the slit is formed on an inner surface of the terminal receiving chamber. When the female terminal is inserted in a proper manner, the engagement projection is fitted into the slit in the tubular portion, and therefore the female terminal is completely inserted into the terminal receiving chamber. On the other hand, when the female terminal is inserted in a wrong manner, the front end of the tubular portion abuts against the engagement projection, thereby preventing the insertion of the female terminal.

5 Claims, 4 Drawing Sheets

ELECTRICAL CONNECTOR WITH TERMINAL RETAINING MEANS

BACKGROUND OF THE INVENTION

1. Field of the Invention

This invention relates to a connector, and more particularly to a connector of the type in which a terminal is prevented from being inserted in a wrong manner into a terminal receiving chamber in a connector housing.

2. Description of the Related Art

In a conventional connector, male or female terminals are received and retained respectively in terminal receiving chambers in a connector housing, and for example, Japanese Utility Model Unexamined Publication No. Sho. 52-120394 discloses a connector in which a plurality of terminals are received in a connector housing. The connector, disclosed in this publication, is shown in FIGS. 6 and 7.

A metal terminal 60, shown in FIG. 6, is formed into an integral construction, using a metal sheet, and has an electrical contact portion 61 of a substantially cylindrical shape at a front end portion thereof, a wire connection portion 64 at a rear end portion thereof, engagement piece portions 62 and 62, and resilient engagement piece portions 63 and 63, the portions 62 and the portions 63 being provided at an intermediate portion thereof.

When the metal terminal 60 is inserted into a terminal receiving chamber 71 in a connector housing 70, the engagement piece portions 62 and 62, together with the resilient engagement portions 63 and 63, prevent lateral movement and turn of the metal terminal 60. The resilient engagement piece portions 63 and 63 serve to limit the position of insertion of the metal terminal 60 into the terminal receiving chamber 71, and prevent the metal terminal 60 from being inserted in a wrong manner into the terminal receiving chamber 71.

The connector housing 70, shown in FIG. 7, is integrally molded of a synthetic resin, and includes a plurality of terminal receiving chambers 71 for respectively receiving the metal terminals 60, a support groove 72, which is formed in an upper wall of each of the terminal receiving chambers 71, and extends in a direction of insertion of the metal terminal 60, and terminal retaining lances 73 for respectively retaining the metal terminals 60 to prevent the same from withdrawal.

The support groove 72 receives the resilient engagement piece portions 63 and 63, and guide the same in the direction of insertion of the metal terminal 60. The provision of this support groove 72 prevents a wrong insertion of the metal terminal 60. Namely, when the metal terminal 60 is inserted in a wrong manner, the resilient engagement piece portions 63 and 63 are brought into abutment against a bottom wall of the terminal receiving chamber 71, thereby preventing the insertion of the metal terminal.

Incidentally, in the production of a wire harness, the metal terminals 60 are beforehand secured respectively to wires, and the plurality of wires each having the metal terminal secured thereto are stocked, and when assembling the wire harness, a required number of wires each with the metal terminal are taken out, and are attached to the connector housing 70.

However, in the conventional metal terminal 60, the engagement piece portions 62 and 62 and the resilient engagement piece portions 63 and 63 are projected, and therefore when a plurality of wires each with the metal terminal are stocked, these wires are entangled with each other through the engagement piece portions 62 and the resilient engagement piece portions 63, which results in a problem that covering or sheaths of the wires are damaged.

SUMMARY OF THE INVENTION

Therefore, an object of this invention is to overcome the above problem, and more specifically to provide a connector in which a terminal is prevented from being inserted in a wrong manner into a terminal receiving chamber in a connector housing, and the entanglement of wires (each having a metal terminal) with each other, as well as damage to sheaths of the wires, is prevented.

In order to achieve the above object, the invention provides a connector comprising: a connector housing having a terminal receiving chamber; and a terminal having an electrical contact portion provided with a tubular portion corresponding in shape to the terminal receiving chamber, wherein a slit is formed in the tubular portion and extends in a direction of insertion of the terminal, and an engagement projection which is slidably fitted in the slit is formed on an inner wall of the terminal receiving chamber.

DETAILED DESCRIPTION OF THE PREFERRED EMBODIMENTS

A preferred embodiment of a connector of the present invention will now be described in detail with reference to the accompanying drawings.

Figure 1:
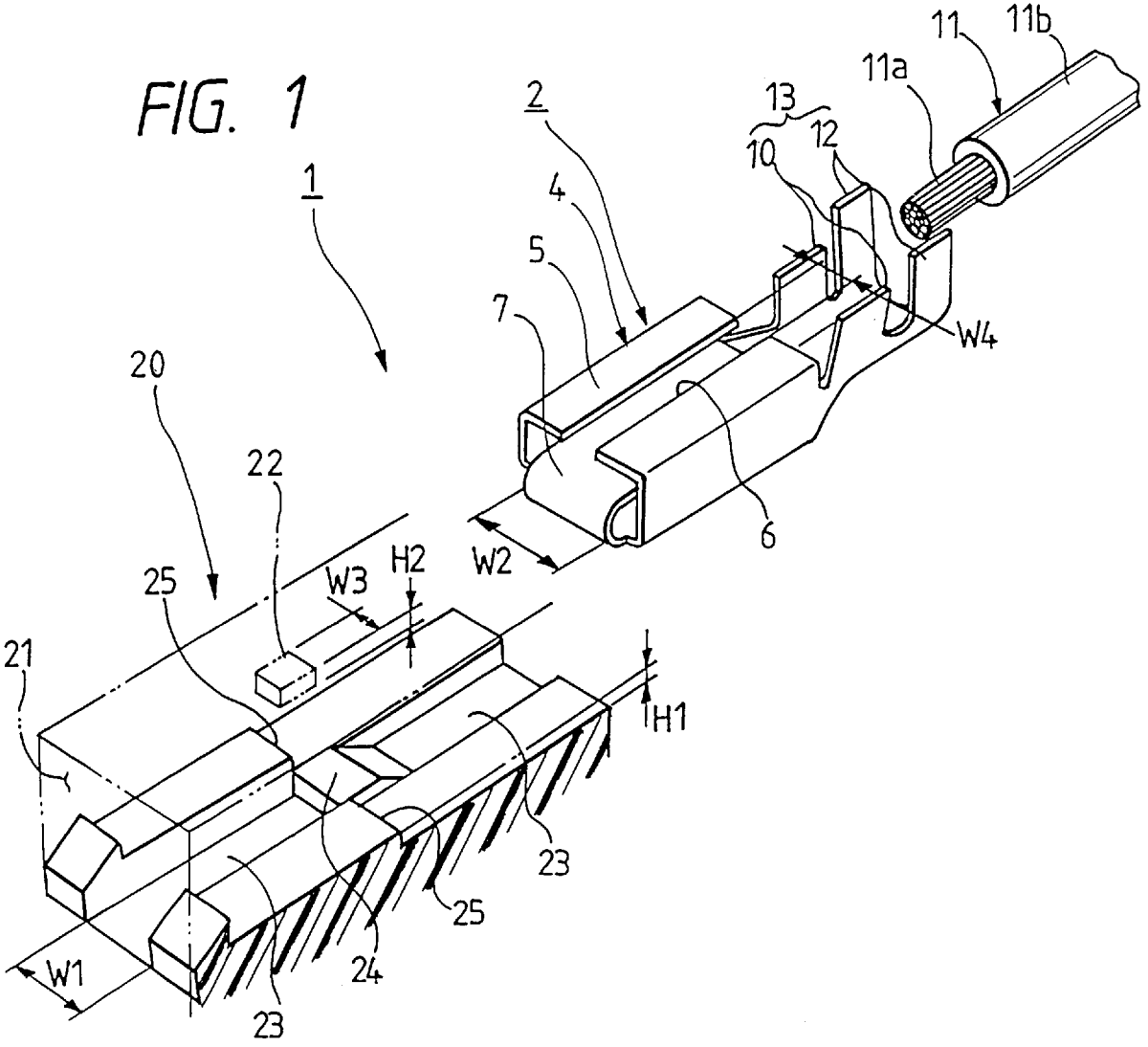
FIG. 1 is an exploded, perspective view of a preferred embodiment of a connector of the present invention.

FIG. 1 is an exploded, perspective view of the connector of the invention.

The connector 1 comprises female terminals 2, and a connector housing 20 into which the female terminals 2 are inserted. Each of the female terminals 2 has an electrical contact portion 4 for electrical connection to a male terminal (not shown), and a wire connection portion 13 formed rearwardly of the electrical contact portion 4. The wire connection portion 13 has wire clamping portions 10 and 10 for clamping a conductor 11*a* of a wire 11, and wire gripping portion 12 and 12 for gripping a sheath 11*b* of the wire 11.

The electrical contact portion 4 has a tubular portion 5 of a rectangular cross-section, a slit 6 formed in an upper wall of the tubular portion 5, a bent piece portion 7 disposed within the tubular portion 5, and a housing retaining lance 8 (see FIG. 2) projecting from a lower surface of the tubular portion 5.

The wire clamping portions 10 and 10 are forcibly bent inwardly to clamp the conductor 11*a* of the wire 11 (see FIG.

3). The wire gripping portions 12 and 12 are forcibly bent inwardly to grip the sheath 11*b* of the wire 11 (see FIG. 3).

The connector housing 20 is integrally molded of a synthetic resin, and includes a plurality of terminal receiving chambers 21 (only one of which is shown) for respectively receiving the female terminals 2, an engagement projection 22, which is formed on an upper wall of each of the terminal receiving chambers 21 so as to be slidably fitted in the slit 6 in the female terminal 2, a groove 23, which is formed in a bottom wall of the terminal receiving chamber 21 so as to movably receive the housing retaining lance 8 of the electrical contact portion 4, a retaining portion 24, which is formed at a substantially central portion of the groove 23 so as to retain the housing retaining lance 8, and abutment portions 25 and 25 formed respectively on opposite sides of the groove 23.

The terminal receiving chamber 21 corresponds in transverse cross-sectional shape to the tubular portion 5 of the female terminal 2. When the female terminal 2 is inserted in a wrong manner, the front end of the tubular portion 5 abuts against the abutment portions 25 and 25, thus preventing further insertion of the female terminal 2.

A width W3 of the engagement projection 22 is smaller than a width W4 of the slit 6 (W3<W4). Therefore, the engagement projection 22 can be fitted in the slit 6.

Figure 2:
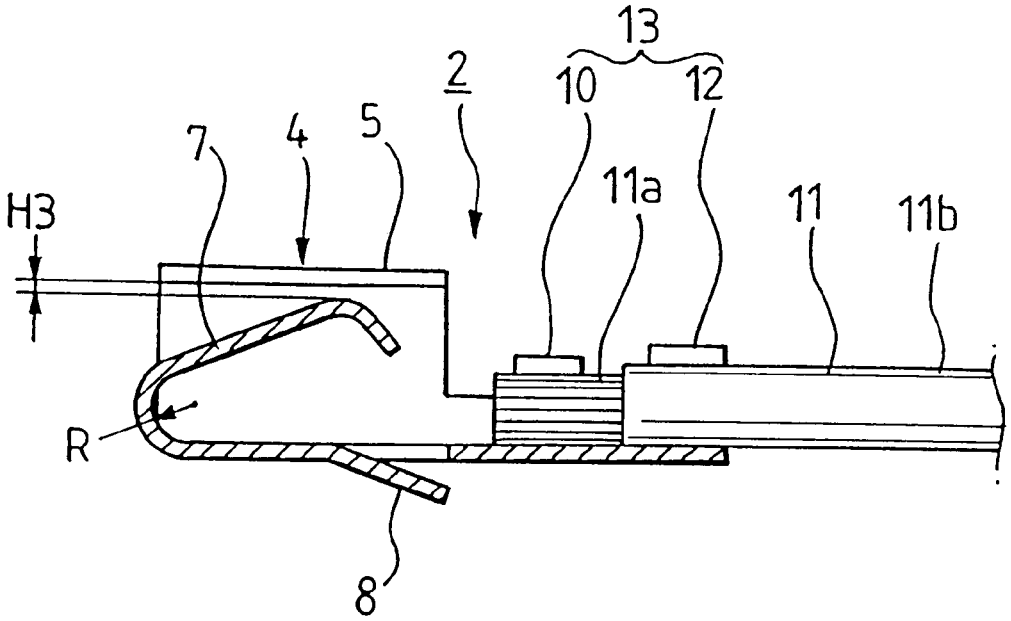
FIG. 2 is a vertical cross-sectional view of a female terminal shown in FIG. 1.

FIG. 2 is a vertical cross-sectional view of the female terminal 2 shown in FIG. 1.

The bent piece portion 7 is arcuately bent at its proximal end with a radius R. A gap H3 is formed between the bent piece portion 7 and the upper wall of the tubular portion 5, and the male terminal (not shown) is inserted into this gap.

Preferably, the relation between the radius R of the bent portion of the bent piece portion 7 and a height H1 of the abutment portions 25 and 25 (see FIG. 1) is so determined that R>H1 is established. Preferably, the relation between a width W1 of the groove 23 and a width W2 of the bent piece portion 7 (see FIG. 1) is so determined that W1<W2 is established. With this construction, the curved surface of the bent portion of the bent piece portion 7 can easily slide over the abutment portions 25 and 25.

Further, preferably, the relation between a height H2 of the engagement projection 22 (see FIG. 1) and the gap H3 is so determined that H2<H3 is established. With this construction, the bent piece portion 7 will not be pressed down by the engagement projection 22. If the bent piece portion 7 is kept pressed down, there is a possibility that the electrical contact of the male terminal (not shown), held between the bent piece portion 7 and the tubular portion 5, with the female terminal 2 is incomplete.

The operation of the connector 1 of the invention, having the above construction, will now be described.

Figure 3:
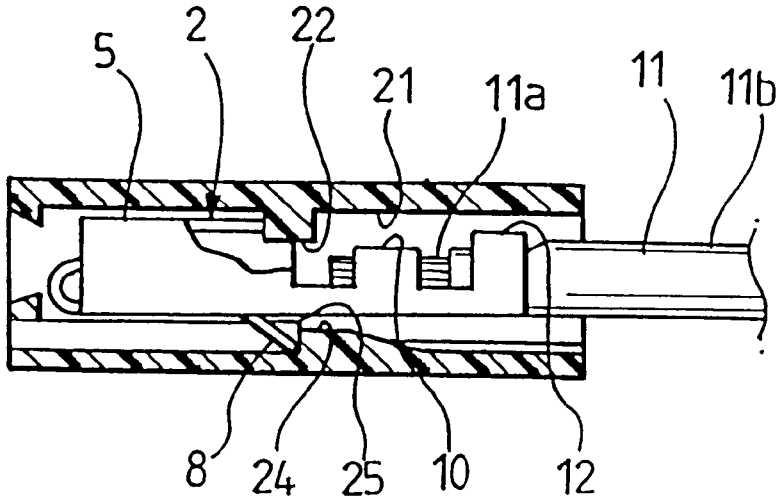
FIG. 3 is a vertical cross-sectional view showing a state in which the female terminal is inserted in a proper manner into a connector housing.

FIG. 3 is a vertical cross-sectional view showing a state in which the female terminal 2 is inserted in a proper manner into the connector housing 20.

When the female terminal 2 is inserted into the terminal receiving chamber 21, the engagement projection 22, formed on the upper wall of the terminal receiving chamber 21, is fitted into the slit 6 (see FIG. 1) in the female terminal 2. As a result, the engagement projection 22 projects into the tubular portion 5 of the female terminal 2, and when the front end of the tubular portion 5 of the female terminal 2 reaches the abutment portions 25 and 25, the tubular portion 5 displaces upward, and slides over the abutment portions 25 and 25. At this time, the housing retaining lance 8 resiliently urges the tubular portion 5 upward relative to the bottom wall of the terminal receiving chamber 21 (in a direction of disengagement with the abutment portions 25 and 25), and therefore the tubular portion 5 can smoothly slide over the abutment portions 25 and 25.

Therefore, the female terminal 2 can be inserted into a predetermined position in the terminal receiving chamber 21. When the female terminal 2 is thus inserted into the predetermined position in the terminal receiving chamber 21, the housing retaining lance 8 is retained by the retaining portion 24, thereby preventing the female terminal 2 from being accidentally withdrawn from the terminal receiving chamber 21.

Figure 4:
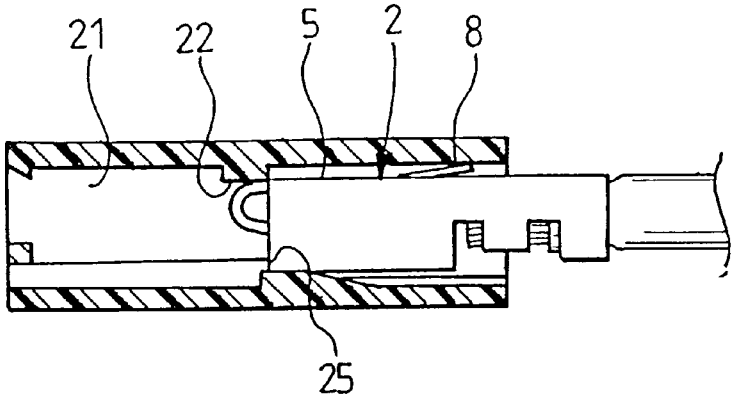
FIG. 4 is a vertical cross-sectional view showing a state in which the female terminal is inserted in a wrong manner into the connector housing.

FIG. 4 is a vertical cross-sectional view showing a state in which the female terminal 2 is inserted in a wrong manner into the connector housing 20.

For example, when the female terminal 2 is inserted upside down into the terminal receiving chamber 21, the slit 6 (see FIG. 1) in the female terminal 2 is positioned at the lower side, and therefore the engagement projection 22, formed on the upper wall of the terminal receiving chamber 21, can not project into the tubular portion 5 of the female terminal 2.

Therefore, when the front end of the tubular portion 5 of the female terminal 2 reaches the abutment portions 25 and 25, the front end of the tubular portion 5 abuts against the abutment portions 25 and 25, so that the tubular portion 5 can not slide over the abutment portions 25 and 25. Moreover, the housing retaining lance 8 is provided on that side of the tubular portion 5 facing away from that side thereof having the slit 6, and therefore when the female terminal 2 is inserted in a wrong manner, the housing retaining lance 8 urges the tubular portion 5 in a direction to abut the front end of the tubular portion 5 against the abutment portions 25 and 25, and therefore the front end of the tubular portion 5 is positively abutted against the abutment portions 25 and 25. Therefore, the female terminal 2 can not be completely received in the terminal receiving chamber 21, thus preventing the female terminal 2 from being inserted in a wrong manner into the terminal receiving chamber 21.

The wrong insertion of the female terminal 2 can be prevented without the need for providing the engagement piece portions 62 and 62 and the resilient engagement piece portions 63 and 63 in the conventional metal terminal 60. Therefore, when producing a wire harness, the wires, having the respective terminals, will not be entangled with each other through such projections formed on the terminals, and the sheathes of the wires will not be damaged.

Figure 5:
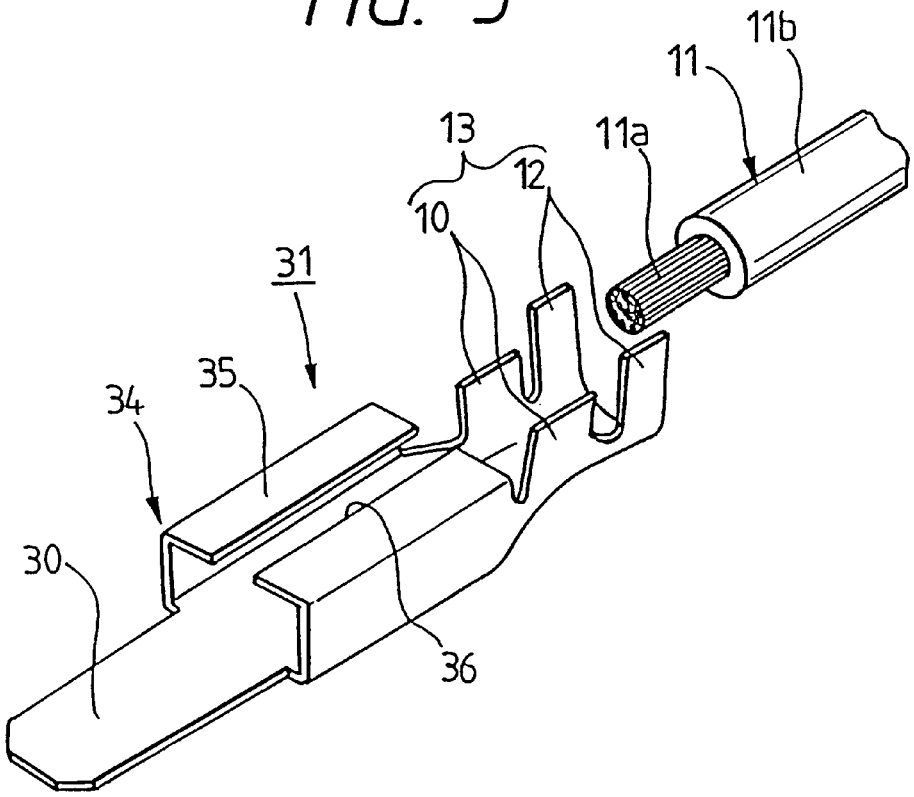
FIG. 5 is an exploded, perspective view of a modified terminal.
Figure 6:
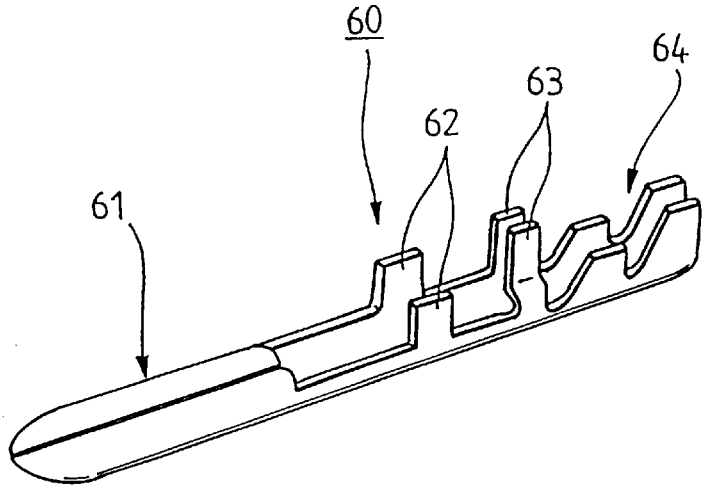
FIG. 6 PRIOR ART
FIG. 6 is a perspective view of a conventional terminal.
Figure 7:
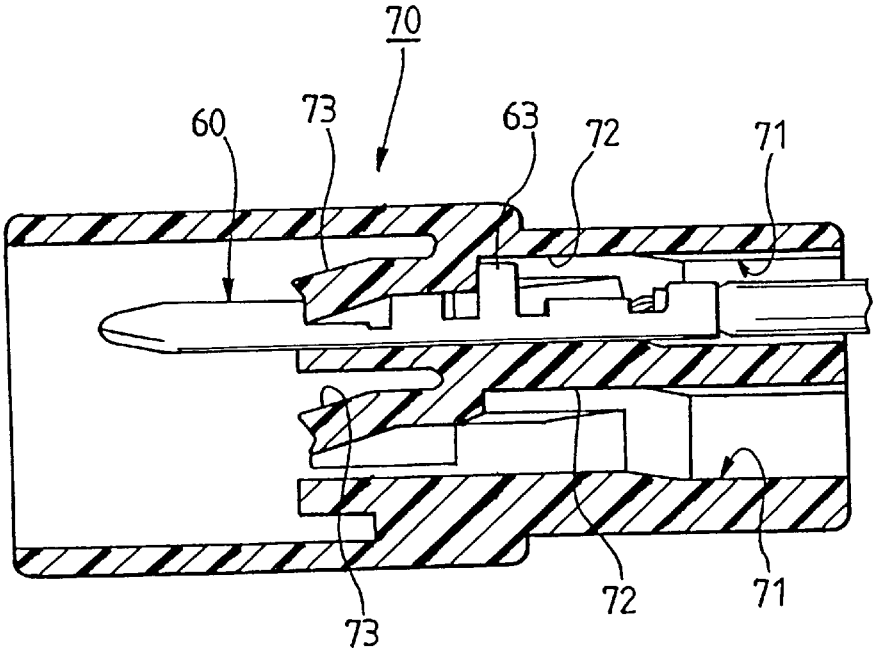
FIG. 7 PRIOR ART
FIG. 7 is a vertical cross-sectional view showing a state in which the terminal, shown in FIG. 6, is inserted into a connector housing.

Although the female terminals 2 are used in the connector 1 of the above embodiment, the invention is not limited to this, and male terminals 31 each as shown in FIG. 5 can be used.

The male terminal 31 has an electrical contact portion 34 for electrical connection to a female terminal (not shown), and a wire connection portion 13 formed rearwardly of the electrical contact portion 34. The male terminal 31 differs from the female terminal 2 of the above embodiment only in the electrical contact portion 34, and the other portions are identical to those of the female terminal 2, and therefore the identical portions will be designated by identical reference numerals, respectively, and explanation thereof will be omitted.

The electrical contact portion 34 comprises a plate-like tab terminal portion 30, and a tubular portion 35 of a rectangular cross-section formed rearwardly of the tab terminal portion 30. The electrical contact portion 34 is inserted into a terminal receiving chamber in a connector housing (not shown). If the male terminal 31 is inserted in a wrong manner, a slit 36, in the male terminal 31, will not receive an engagement projection (not shown) provided in the terminal receiving chamber, so that this engagement projection can not project into the tubular portion 35.

Namely, like the female terminal 2 of the above embodiment, the male terminal 31 can be prevented from being inserted in a wrong manner into the terminal receiving chamber. When producing a wire harness, the wires each having the metal terminal will not be entangled with each other, and sheathes of the wires will not be damaged.

In the present invention, the constructions of the terminals and the terminal receiving chambers, as well as the configurations of the engagement projections, are not limited to those of the connectors of the above embodiments, and various modifications can be made.

As described above, in the connector of the present invention, when the terminal is inserted in a proper manner, the engagement projection of the connector housing is fitted into the slit in the tubular portion, so that the terminal can be properly inserted into the terminal receiving chamber in the connector housing. On the other hand, when the terminal is inserted in a wrong manner, the front end of the tubular portion abuts against the engagement projection, thereby preventing the insertion of the terminal.

Thus, by merely providing the slit in the terminal and without the need for providing any projection on the terminal, the wrong insertion of the terminal can be prevented. Therefore, even if a plurality of wires, each having the metal terminal beforehand secured thereto, are stocked for producing a wire harness, the wires each with the metal terminal are prevented from being entangled with each other. Besides, since any projection is formed on the terminal, the sheath of the wire will not be damaged.

What is claimed is:

1. A connector comprising:

a connector housing having a terminal receiving chamber; and a terminal having an electrical contact portion provided with a tubular portion corresponding in shape to said terminal receiving chamber, wherein a slit is formed in said tubular portion and extends in a direction of insertion of said terminal, and an engagement projection is formed on an inner wall of said terminal receiving chamber and slidably fitted in said slit during insertion, and a bent metal piece is disposed in said tubular portion and arcuately bent at a proximal end thereof for electrically contacting a second terminal which is received between said bent metal piece and said tubular portion, said bent metal piece being bent along a direction perpendicular to the direction of insertion of said terminal, wherein an abutment portion is formed on an inner wall of said terminal receiving chamber facing the inner wall having said engagement projection formed thereon, and when said terminal is inserted in a wrong manner, a front end of said tubular portion abuts against said abutment portion so that said abutment portion prevents said terminal from being inserted in said housing improperly.

2. The connector according to claim 1, wherein a housing retaining lance is formed on an end of said bent metal piece and is provided on a side of said tubular portion facing away from the side thereof having said slit, and when said terminal is inserted in a proper manner, said housing retaining lance urges said tubular portion in a direction of disengagement with said abutment portion until said tubular portion is completely engaged in said housing.

3. The connector according to claim 2, wherein a groove is formed in a bottom wall of said terminal receiving chamber so as to movably receive said housing retaining lance as said terminal is being inserted in said terminal receiving chamber.

4. The connector according to claim 3, wherein a retaining portion is formed at a substantially central portion of said groove so as to retain said housing retaining lance.

5. The connector according to claim 1, wherein said abutment portion has a height having a value which is less than a value of a radius of the arcuately bent proximal end of said bent metal piece, so that said terminal only inserts easily into said connector housing when said terminal is properly aligned during insertion.

* * * * *